US010962023B2

(12) United States Patent
Huang et al.

(10) Patent No.: US 10,962,023 B2
(45) Date of Patent: Mar. 30, 2021

(54) VENTILATION FAN WITH LAMP

(71) Applicant: DELTA ELECTRONICS, INC., Taoyuan (TW)

(72) Inventors: Yu-Hsiang Huang, Taoyuan (TW); Chih-Hua Lin, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 120 days.

(21) Appl. No.: 16/182,172

(22) Filed: Nov. 6, 2018

(65) Prior Publication Data

US 2019/0072110 A1 Mar. 7, 2019

Related U.S. Application Data

(63) Continuation of application No. 14/616,126, filed on Feb. 6, 2015, now abandoned.

(30) Foreign Application Priority Data

Oct. 15, 2014 (TW) ..... 103135619 A

(51) Int. Cl.
*F04D 29/42* (2006.01)
*F21V 33/00* (2006.01)
(Continued)

(52) U.S. Cl.
CPC ..... *F04D 29/4226* (2013.01); *F04D 29/005* (2013.01); *F04D 29/602* (2013.01);
(Continued)

(58) Field of Classification Search
USPC ..... 415/121.3
See application file for complete search history.

(56) References Cited

U.S. PATENT DOCUMENTS 4,681,024 A 7/1987 Ivey
5,934,783 A 8/1999 Yoshikawa
(Continued)

FOREIGN PATENT DOCUMENTS

CN 102758799 A 10/2012
JP H0517843 U 3/1993
(Continued)

*Primary Examiner* — Robert K Arundale
*Assistant Examiner* — Richard K. Durden
(74) *Attorney, Agent, or Firm* — Muncy, Geissler, Olds and Lowe, P.C.

(57) ABSTRACT

A ventilation fan with lamp is used to be installed to a ceiling including an installation opening and comprises a housing, a fan module and a lamp module. The housing includes a first opening and a second opening, and the first opening is aligned with the installation opening. The fan module is disposed in the housing. The lamp module is fixed to the first opening by a plurality of elastic elements passing through the housing and includes a lamp cover, a base and a lens. The lamp cover includes a flange portion and a plurality of contact portions, the flange portion and the contact portions are disposed outside the installation opening of the ceiling. The lamp module is connected to the ceiling via the contact portions to make a gap between the lamp cover and the ceiling, and the gap serves as an air inlet of the ventilation fan.

17 Claims, 8 Drawing Sheets

(51) Int. Cl.

| | |
|---|---|
| ***F24F 7/007*** | (2006.01) |
| ***F21S 8/02*** | (2006.01) |
| ***F04D 29/00*** | (2006.01) |
| ***F04D 29/60*** | (2006.01) |
| *F04D 29/28* | (2006.01) |
| *F21Y 115/10* | (2016.01) |

(52) U.S. Cl.
CPC ..... *F21S 8/026* (2013.01); *F21V 33/0096* (2013.01); *F24F 7/007* (2013.01); *F04D 29/282* (2013.01); *F21Y 2115/10* (2016.08); *F24F 2221/02* (2013.01)

(56) References Cited

U.S. PATENT DOCUMENTS

| | | | | |
|---|---|---|---|---|
| 7,470,043 | B2 | 12/2008 | Mehta | |
| 8,820,983 | B2 * | 9/2014 | Schmitt | F21V 21/045 362/364 |
| 9,416,989 | B1 * | 8/2016 | Tom | F24F 13/078 |
| 9,476,608 | B2 | 10/2016 | Yang et al. | |
| 2008/0062643 | A1 | 3/2008 | Mehta | |
| 2008/0232116 | A1 | 9/2008 | Kim | |
| 2009/0009985 | A1 | 1/2009 | Mehta | |
| 2009/0073702 | A1 | 3/2009 | Craw et al. | |
| 2012/0087128 | A1 * | 4/2012 | Zakula | F21V 33/0088 362/249.02 |
| 2012/0170255 | A1 | 7/2012 | McMillan | |
| 2013/0088855 | A1 * | 4/2013 | Ye | F21V 33/0096 362/96 |
| 2013/0266443 | A1 * | 10/2013 | Yang | F24F 7/065 416/5 |
| 2013/0315731 | A1 | 11/2013 | Yang et al. | |
| 2014/0078718 | A1 * | 3/2014 | Li | F21V 33/0088 362/96 |
| 2015/0050876 | A1 * | 2/2015 | Sakai | F24F 11/0001 454/256 |
| 2015/0176833 | A1 * | 6/2015 | Horng | F21V 15/01 362/362 |
| 2015/0276197 | A1 * | 10/2015 | Horng | F21V 29/60 362/294 |
| 2017/0010018 | A1 | 1/2017 | Yang et al. | |

FOREIGN PATENT DOCUMENTS

| | | | |
|---|---|---|---|
| JP | H09303839 | A | 11/1997 |
| TW | 272606 | | 3/1996 |
| TW | M326998 | | 2/2008 |
| TW | 200834019 | A | 8/2008 |
| TW | 201614175 | A | 4/2016 |
| TW | 201634871 | A | 10/2016 |

* cited by examiner

VENTILATION FAN WITH LAMP

CROSS REFERENCE TO RELATED APPLICATIONS

This application is a Continuation Application (CA) of an earlier filed, pending, application, having application Ser. No. 14/616,126 and filed on Feb. 6, 2015, the content of which, including drawings, is expressly incorporated by reference herein.

BACKGROUND OF THE INVENTION

Field of Invention

The invention relates to a ventilation fan and, in particular, to a ventilation fan with lamp.

Related Art

For the sake of blocking the outdoor noise and heat and remaining the indoor temperature, the buildings are usually constructed by special materials to create unventilated rooms. Accordingly, a proper ventilation mechanism is required to exhaust the harmful contaminations.

In order to improve the air convection in the rooms, many buildings are equipped with ventilation fans for supplying the fresh air. However, the conventional ventilation fan only has the ventilation function, and the applicability thereof is thus limited.

SUMMARY OF THE INVENTION

A ventilation fan with lamp according to this invention is used to be installed to a ceiling including an installation opening and comprises a housing, a fan module and a lamp module. The housing includes a first opening and a second opening, and the first opening is aligned with the installation opening. The fan module is disposed in the housing. The lamp module is disposed through the installation opening and the first opening and includes a lamp cover. The lamp cover includes a flange portion and a plurality of contact portions connected to the flange portion. The flange portion and the contact portions are disposed on the side of the ceiling away from the housing. The contact portions are connected to the ceiling to make a gap between the lamp cover and the ceiling, and the gap serves as an air inlet of the ventilation fan.

In one embodiment, the ends of the contact portions connected to the ceiling are connected by a connection element.

In one embodiment, the lamp module further includes a base and a lens. The base is disposed on the lamp cover and inside the housing. The lens is disposed opposite to the base and connected to the lamp cover.

In one embodiment, the fan module includes a fan casing, an impeller and a motor. The fan casing includes an inlet opening and an outlet opening which communicates with the second opening. The impeller is disposed in the fan casing. The motor is connected to and drives the impeller to rotate.

In one embodiment, the outer diameters of the motor and impeller are less than the inner diameter of the first opening, respectively.

In one embodiment, at least half volume of the fan module is on the projection plane of the first opening.

In one embodiment, the housing further includes two extension portions which have slots, and the extension portions are disposed inside the housing.

In one embodiment, the lamp module is fixed to the first opening by a plurality of elastic elements passing through the slots.

In one embodiment, the gap is between 5 mm and 15 mm.

A ventilation fan with lamp according to this invention comprises a housing, a fan module and a lamp module. The housing includes a first opening and a second opening. The fan module is disposed in the housing. The lamp module is disposed through the first opening and includes a lamp cover. The lamp cover includes a flange portion and a plurality of contact portions connected to the flange portion. The flange portion and the contact portions are disposed outside the housing. The contact portions form a plurality of gaps therebetween, and the gaps serve as an air inlet of the ventilation fan.

In one embodiment, the ends of the contact portions away from the flange portion are connected by a connection element.

In one embodiment, the lamp module further includes a base and a lens. The base is disposed on the lamp cover and inside the housing. The lens is disposed opposite to the base and connected to the lamp cover.

In one embodiment, the fan module includes a fan casing, an impeller and a motor. The fan casing includes an inlet opening and an outlet opening which communicates with the second opening. The impeller is disposed in the fan casing. The motor is connected to and drives the impeller to rotate.

In one embodiment, the outer diameters of the motor and impeller are less than the inner diameter of the first opening, respectively.

In one embodiment, at least half volume of the fan module is on the projection plane of the first opening.

In one embodiment, the housing further includes two extension portions which have slots, and the extension portions are disposed inside the housing.

In one embodiment, the lamp module is fixed to the first opening by a plurality of elastic elements passing through the slots.

In one embodiment, the heights of the contact portions are between 5 mm and 15 mm.

As mentioned above, in this invention, the lamp module is integrated to the ventilation fan and thereby the used space of the ceiling can be reduced to enhance the space usage efficiency.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
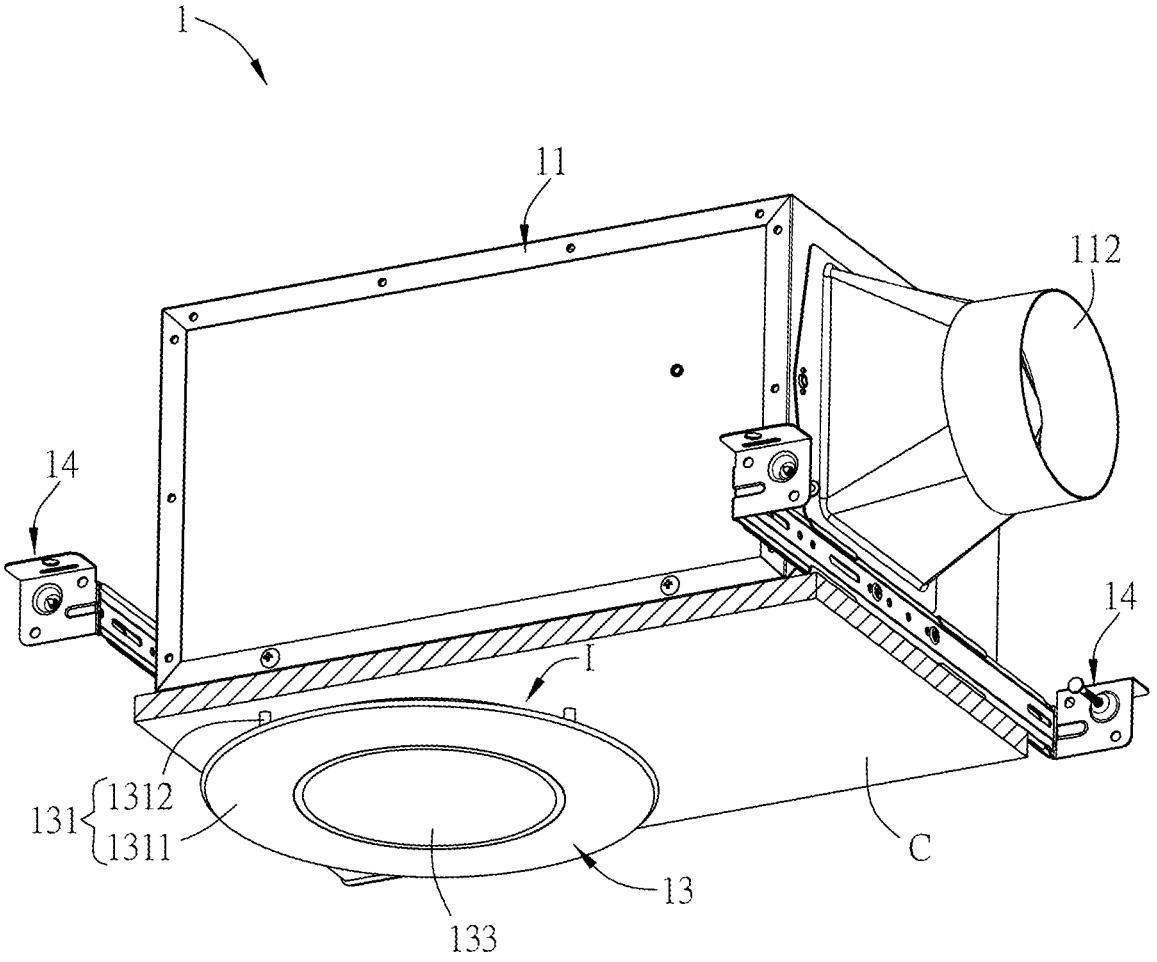
FIG. 1A is a schematic diagram of a ventilation fan with lamp of the first embodiment of the invention.
Figure 1B:
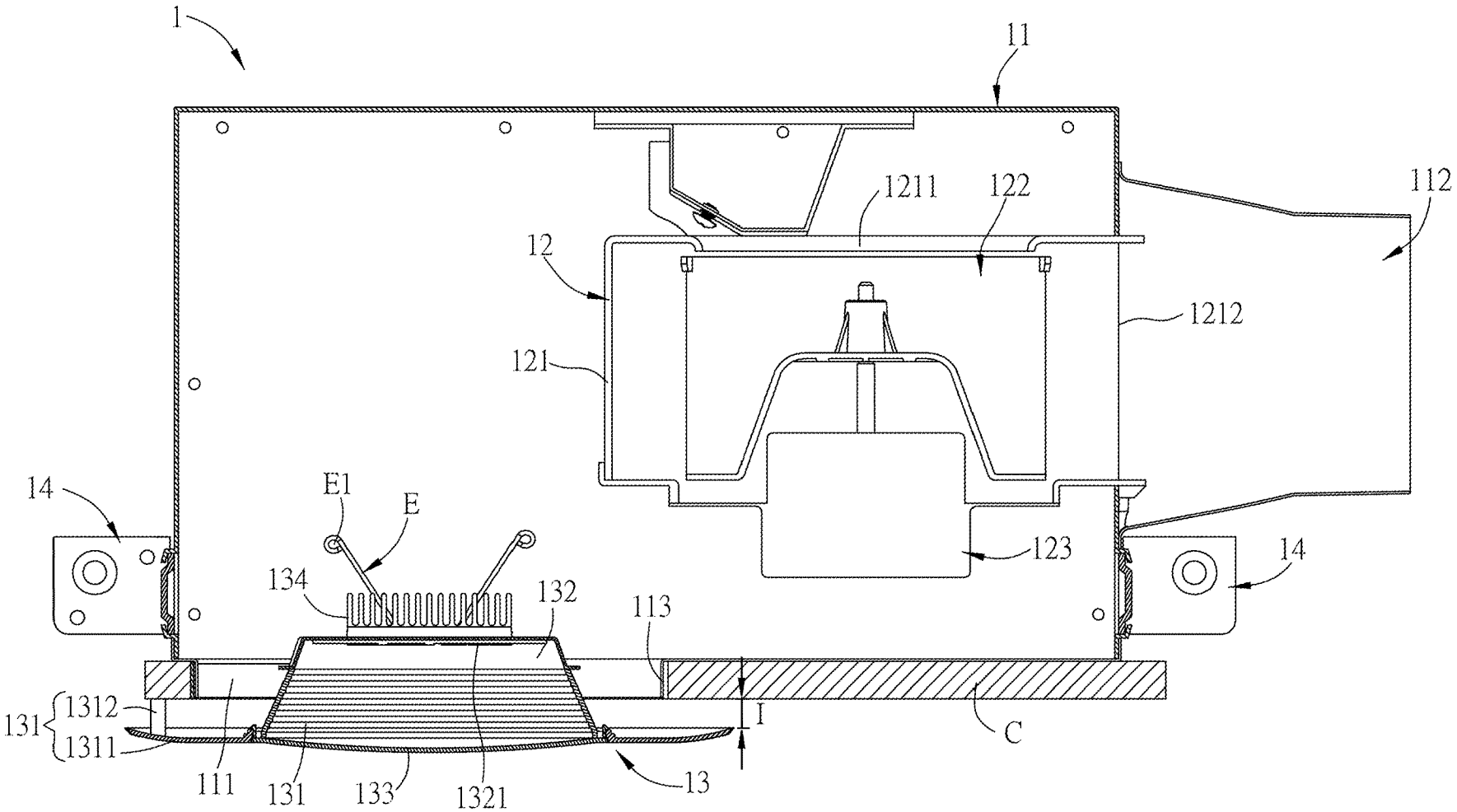
FIG. 1B is a sectional diagram of the ventilation fan in FIG. 1A.
Figure 1C:
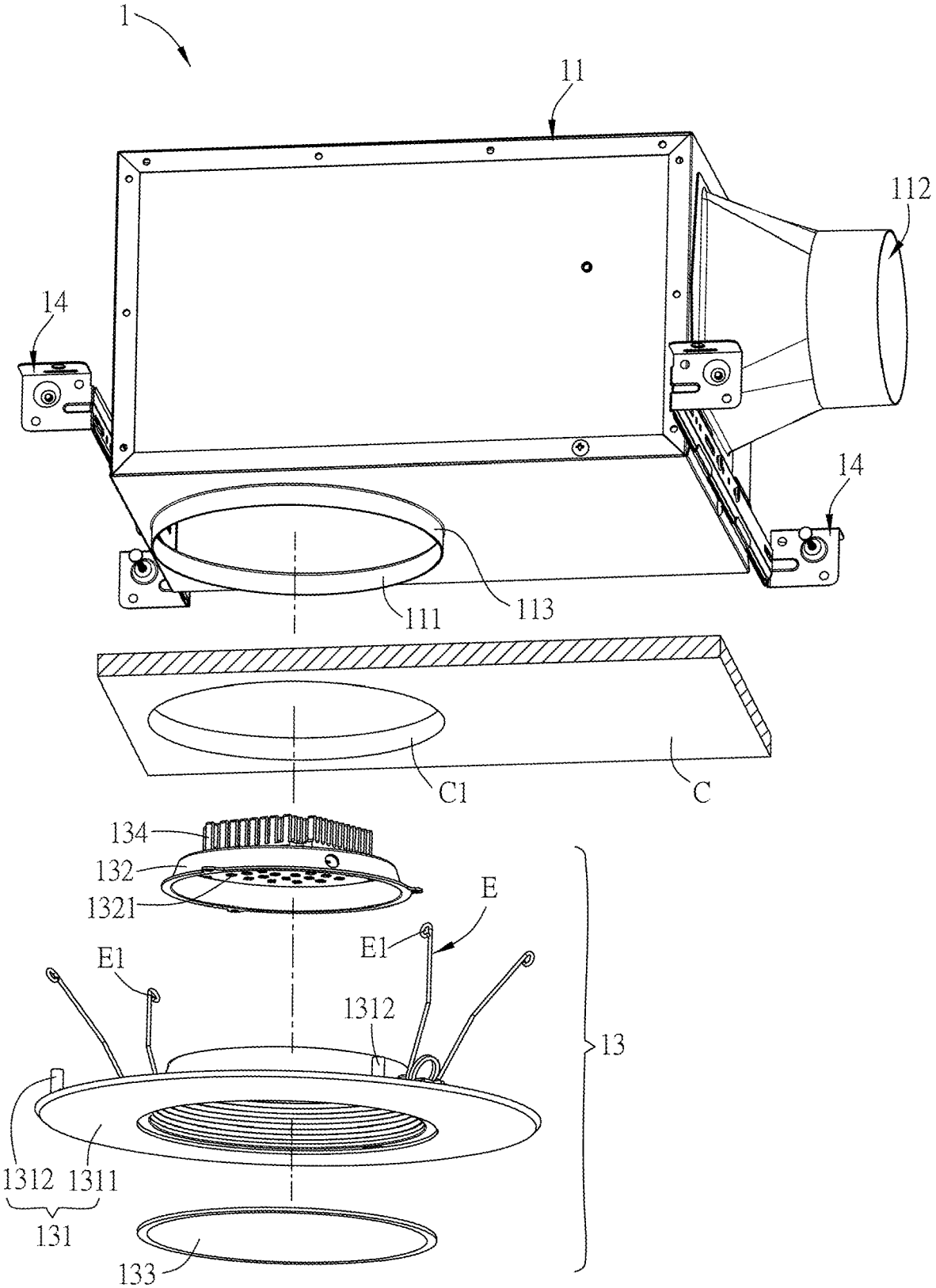
FIG. 1C is a exploded diagram of the ventilation fan in FIG. 1A.

FIG. 1A is a schematic diagram of a ventilation fan with lamp of the first embodiment of the invention, FIG. 1B is a sectional diagram of the ventilation fan in FIG. 1A, and FIG. 1C is an exploded diagram of the ventilation fan in FIG. 1A. As shown in FIGS. 1A, 1B, 1C, the ventilation fan with lamp 1 (abbreviated to the ventilation fan 1 hereinafter) is installed to a ceiling C including an installation opening C1. For the clarity of the figure to facilitate the illustration of the ventilation fan of this embodiment, only a part of the ceiling is shown. Herein, the ventilation fan 1 includes a housing 11, a fan module 12 and a lamp module 13. Moreover, the ventilation fan 1 of this embodiment further includes two installation brackets 14, which can be connected to the housing 11 and ceiling C by screwing, for example, to fix the housing 11 to the ceiling C. However, this invention is not limited thereto.

In this embodiment, the housing 11 is approximately a six-sided box structure and includes a first opening 111 and a second opening 112. The first opening 111 and the second opening 112 are located on different sides of the housing 11. In other embodiments, the housing 11 may be a cylindrical box structure, but this invention is not limited thereto. The first opening 111 is aligned with the installation opening C1 of the ceiling C, and the second opening 112 serves as an air outlet of the ventilation fan 1.

The fan module 12 is disposed in the housing 11. In this embodiment, the fan module 12 includes a fan casing 121, an impeller 122 and a motor 123. The impeller 122 is disposed in the fan casing 121, and the motor 123 is connected to the impeller 122 to drive the rotation of the impeller 122. The fan casing 121 includes an inlet opening 1211 and an outlet opening 1212, and the outlet opening 1212 communicates with the second opening 112. Moreover, the impeller 122 and the motor 123 can be fixed in the fan casing 121 by locking or engaging for example.

In this embodiment, the housing 11 includes an annular wall portion 113 disposed at the first opening 111 and extended towards the ceiling C. The height of the annular wall portion 113 is less than or equal to the thickness of the ceiling C, and the outer diameter of the annular wall portion 113 is slightly less than or equal to the inner diameter of the installation opening C1. Therefore, by the annular wall portion 113 fixed into the ceiling C, the lateral displacement of the housing 11 can be avoided.

The lamp module 13 is fixed into the installation opening C1 and the first opening 111. In this embodiment, the lamp module 13 includes a lamp cover 131, a base 132 and a lens 133. The base 132 is disposed on the lamp cover 131 and inside the housing 11. The lens 133 is disposed opposite to the base 132 and connected to the lamp cover 131. Herein for example, the lens 133 is disposed on the side of the lamp cover 131 away from the housing 11, and that is, the lamp cover 131 is disposed between the lens 133 and the base 132. In this embodiment, the base 132 is configured with at least a light emitting element 1321, which can be a bulb or LED lamp for example. Moreover, the lamp module 13 can further include a heat dissipation element 134 such as a heat dissipation fin disposed on the side of the base 132 away from the light emitting element 1321 for the heat dissipation.

The lamp cover 131 includes a flange portion 1311 and a plurality of contact portions 1312 connected with the flange portion 1311. The flange portion 1311 and the contact portions 1312 are disposed outside the housing 11 and especially on the side of the ceiling C away from the housing 11. Besides, the outer diameter of the flange portion 1311 is larger than the diameter of the installation opening C1. In this embodiment, the extension direction of the flange portion 1311 is substantially parallel to the ceiling C. The contact portions 1312 form a plurality of gaps therebetween and are connected to the ceiling C so that a gap is formed between the lamp cover 131 and the ceiling C. The above gap serves as the air inlet I of the ventilation fan 1 and is a side-entry air inlet. Therefore, the height of the air inlet I can be fixed even if the ventilation fan 1 is installed to a thicker or thinner ceiling, because the air inlet I is formed by the contact portions 1312 connected to the ceiling C. That is, the height of the air inlet I is determined by the height of the contact portions 1312. The contact portion 1312 can be a cylindrical structure, taper structure or sheet structure, and the cylindrical structure is given as an example here but not for limiting the scope of the invention. Moreover, the height of the contact portion 1312 or the gap between the lamp cover 131 and the ceiling C can be between 5 mm and 15 mm and favorably 9 mm.

As a whole, when the fan module 12 operates, the motor 12 rotates to drive the rotation of the impeller 122 so that the indoor air enters the housing 11 through the air inlet I. To be noted, the air will flow through the air inlet I and the gap between the installation opening C1 and the lamp cover 131 and also through the gap between the first opening 111 and the lamp cover 131. In other words, the air flows from the outside of the lamp cover 131 to the inside of the housing 11. Then, the air will flow through the inlet opening 1211 of the fan casing 121 and flow out through the outlet opening 1212 and the second opening 112. Moreover, the lamp module 13 has a switch (not shown) which can be turned on or off according to the user's requirement. In this embodiment, the lamp module 13 is integrated to the ventilation fan 1, and therefore some of the ceiling space can be released to enhance the usage efficiency of the space.

Figure 2:
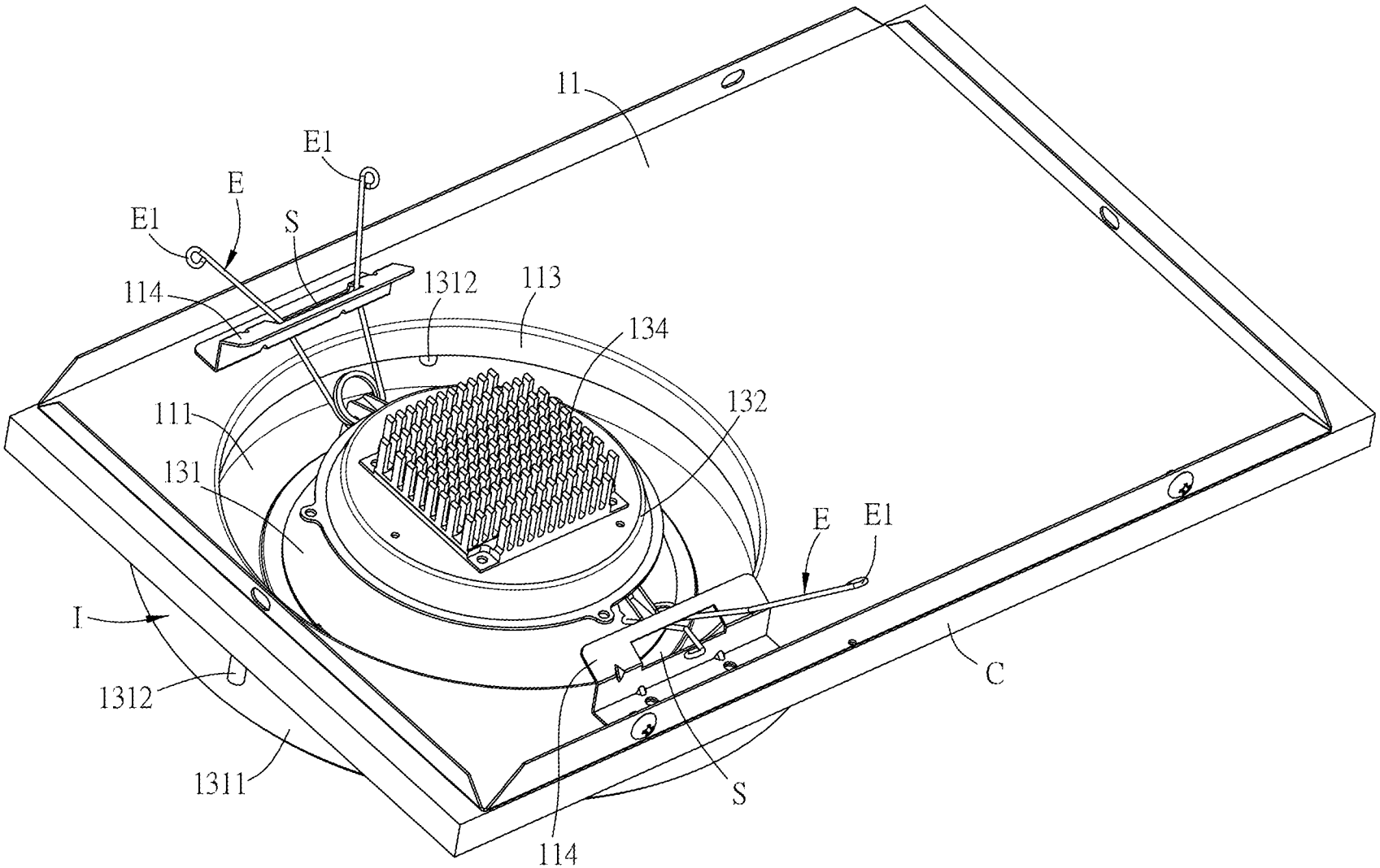
FIG. 2 is a schematic diagram showing the connection of the lamp module and housing.

In this embodiment, the lamp module 13 is fixed to the first opening 111 by two elastic elements E passing through the housing 11. For the convenient illustration, FIG. 2 just shows a part of the housing 11. The elastic element E is roughly a metal element with a V-shaped structure, and the bending portion thereof is connected to the lamp cover 131. Each of two ends of the elastic element E has a hook structure E1. The housing 11 further includes two extension portions 114 which have slots S. The extension portion 114 is disposed inside the housing 11, and the slot S is formed on the extension portion 114. Herein, when the lamp module 13 is mounted to the first opening 111 of the housing 11, the elastic elements E are disposed to pass through the slots S and the hook structures E1 will be fixed to the extension portions 114. When the lamp module 13 is dismounted, the user can dismount the lamp module 13 by directly pulling the lamp module 13 without using any other auxiliary tools. Therefore, the lamp module 13 can be easily dismounted, and this facilitates the maintenance of the ventilation fan 1. Besides, due to the design of the elastic element E, the lamp module 13 will be suspended in the air by the hook structure E1 engaged on the extension portion 114 during the disassembly instead of falling down directly. When the lamp module 13 needs to be completely dismounted, the user can press the elastic elements E to remove it.

The outer diameters of the motor 123 and impeller 122 can be less than the inner diameter of the first opening 111, respectively. That is, the user can dismount the motor 123 and the impeller 122 from the fan casing 121 or mount them to the fan casing 121 through the first opening 111 to facilitate the maintenance of the fan module 12.

As shown in FIG. 1B, in this embodiment, the inlet opening 1211 of the fan casing 121 is located on the surface of the fan casing 121 away from the first opening 111. That is, the inlet opening 1211 and the first opening 111 face the opposite directions and the fan module 12 is disposed reversely. Therefore, through the reverse installation of the fan module 12, when the ventilation fan 1 is installed in the bathroom, the damp won't directly enter the fan module 12 through the air inlet I so that the fan module 12 and the components thereof can be more kept away from the dampness.

Figure 3A:
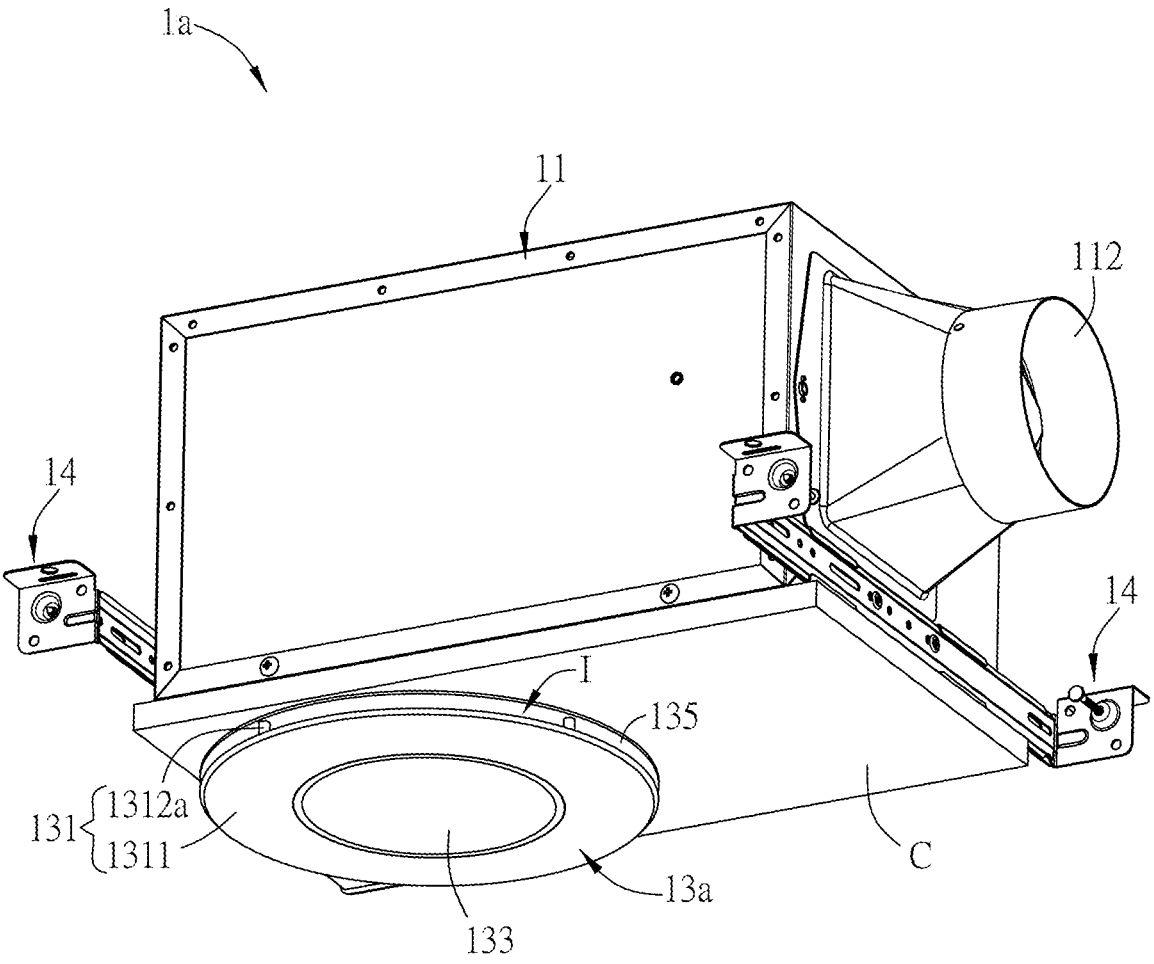
FIG. 3A is a schematic diagram of a ventilation fan with lamp of the second embodiment of the invention.
Figure 3B:
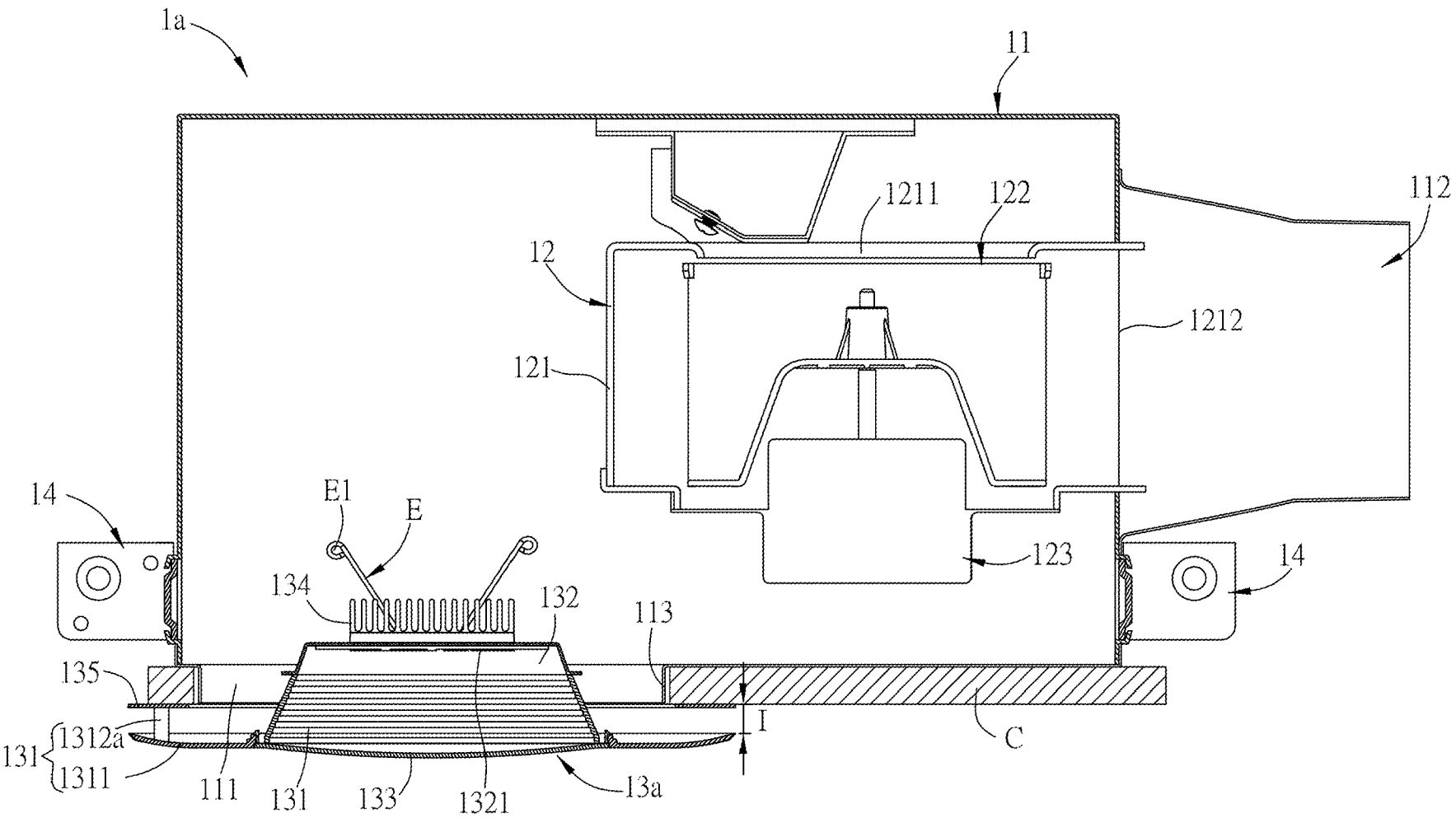
FIG. 3B is a sectional diagram of the ventilation fan in FIG. 3A.

FIG. 3A is a schematic diagram of a ventilation fan with lamp of the second embodiment of the invention, and FIG. 3B is a sectional diagram of the ventilation fan in FIG. 3A. As shown in FIGS. 3A and 3B, the ventilation fan 1*a* of this embodiment is approximately the same as the first embodiment, and the main difference therebetween is that the ends of the contact portions 1312*a* of the lamp module 13*a* away from the flange portion 1311 (i.e. the ends connected to the ceiling C) are connected by a connection element 135. In this embodiment, the connection element 135 is an annular plate and disposed parallel to and separately from the flange portion 1311. The connection element 135 and the contact portions 1312*a* are collectively connected to the ceiling C to provide a better look. The illustration of the housing 11 and fan module 12 can be comprehended by referring to the first embodiment and therefore is omitted here for conciseness.

Figure 3C:
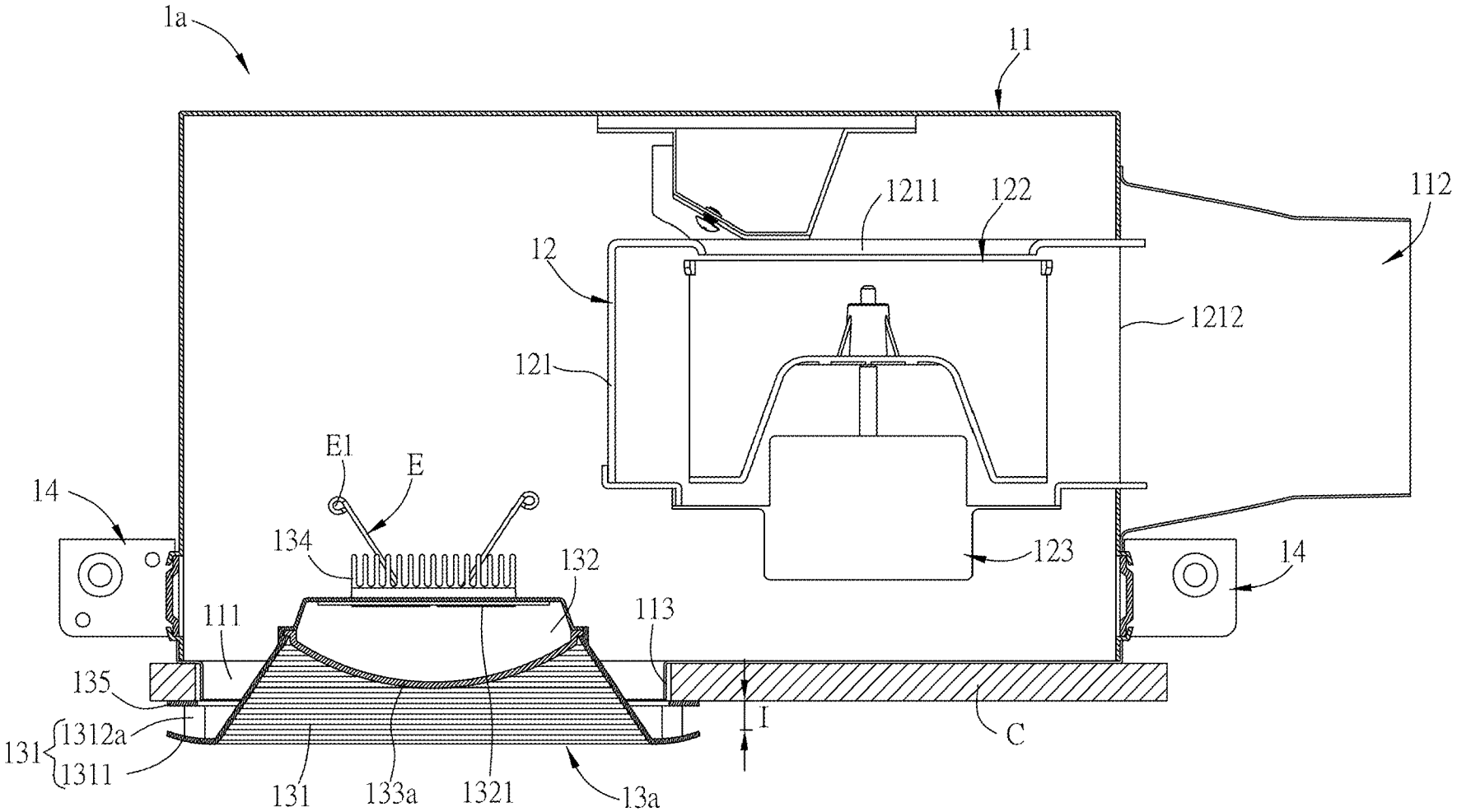
FIG. 3C is a schematic sectional diagram of a ventilation fan of another embodiment of the invention.

FIG. 3C is a schematic sectional diagram of a ventilation fan of another embodiment of the invention. As shown in FIG. 3C, this embodiment is approximately the same as the above second embodiment, and the main difference therebetween is that the lens 133*a* is disposed between the lamp cover 131 and the base 132 and inside the housing 11. Certainly, the lens 133*a* also can be disposed at the first opening 111 so that a part of the lens 133*a* is disposed inside the housing and another part of the lens 133*a* is exposed from the housing 11.

Figure 4:
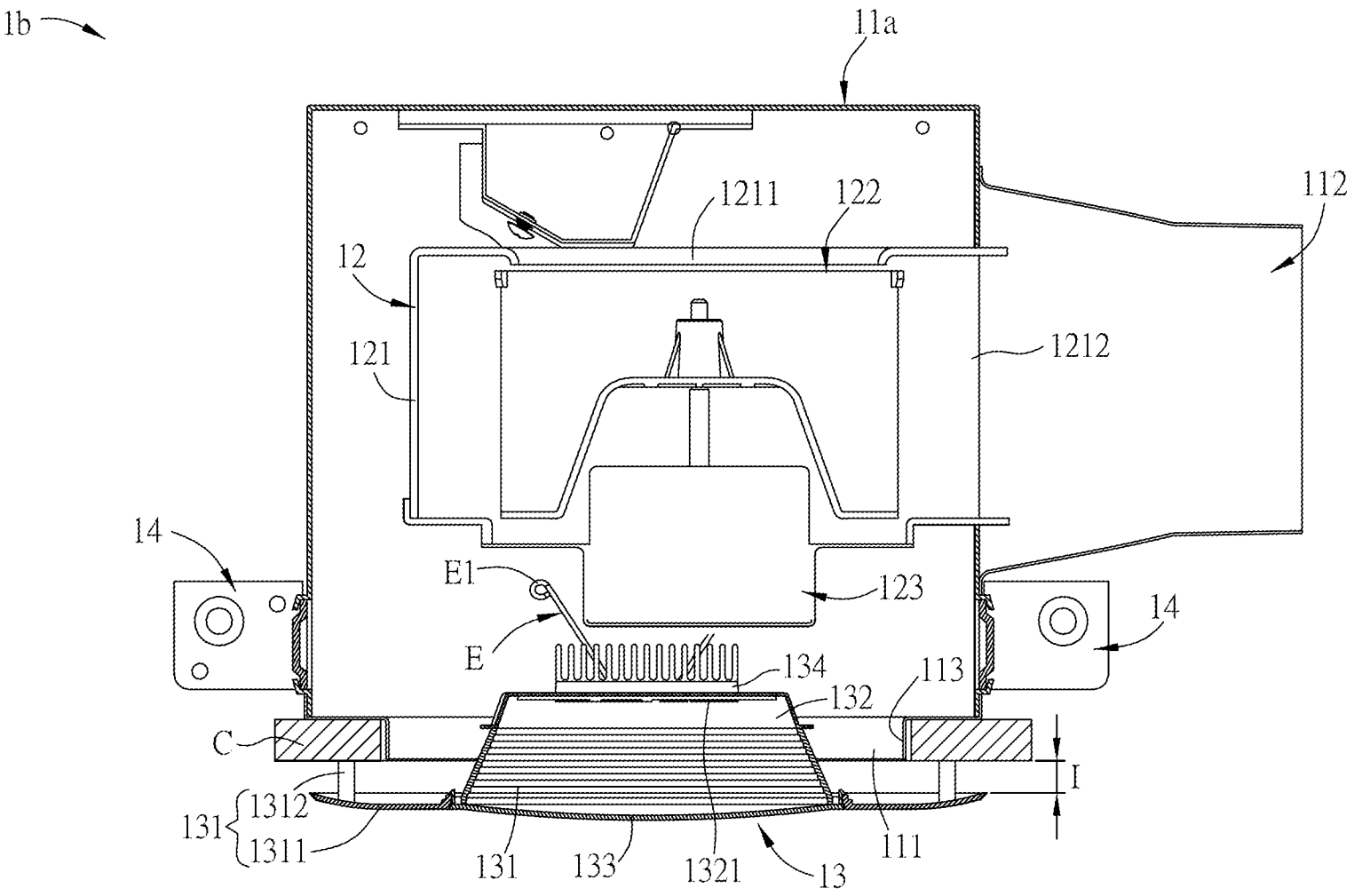
FIG. 4 is a schematic sectional diagram of a ventilation fan with lamp of the third embodiment of the invention.

FIG. 4 is a schematic sectional diagram of a ventilation fan with lamp of the third embodiment of the invention. As shown in FIG. 4, the ventilation fan 1*b* of this embodiment is approximately the same as the first embodiment, and the main difference therebetween is that the size of the housing 11*a* of this embodiment is less than that of the housing 11 of the above embodiment so that at least half volume of the fan module 12 is on the projection plane of the first opening 111. Thereby, the space in the ceiling interlayer for installing the ventilation fan 1*b* can be lessened to enhance the space usage efficiency. Moreover, in some embodiments, the lamp module 13 can be replaced by the lamp module 13*a* of the second embodiment. That is, the lamp module 13*a* including the connection element 135 is disposed at the housing 11*a* with a smaller size. Furthermore, the descriptions of the fan modules 12 and 13 can be comprehended by referring to the first embodiment and are therefore omitted for conciseness.

Summarily, in this invention, the lamp module is integrated to the ventilation fan and thereby the used space of the ceiling can be reduced to enhance the space usage efficiency.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A ventilation fan with a lamp for installation in a ceiling, the ceiling having an installation opening; the ventilation fan comprising:

a housing including a first opening and a second opening, wherein the first opening is configured to be aligned with the installation opening;

a fan module disposed in the housing; and a lamp module fixed to the first opening by a plurality of elastic elements passing through the housing, said lamp module including:

a lamp cover including a flange portion and a plurality of contact portions connected to the flange portion, wherein the flange portion and the plurality of contact portions are configured to be disposed outside the installation opening of the ceiling, so that the ceiling is disposed between the housing and the flange portion, the plurality of contact portions are configured to be disposed between the ceiling and the flange portion, the lamp module is configured to be connected to the ceiling via the plurality of contact portions so as to make a gap between the lamp cover and the ceiling, the gap thereby serving as an air inlet of the ventilation fan;

a base disposed on the lamp cover, wherein the base does not directly contact with the housing; and a lens disposed opposite to the base and connected to the lamp cover;

wherein an annular wall portion of the housing is configured to be at the installation opening, the base of the lamp module is surrounded by the annular wall portion of the housing at the installation opening, and a diameter of the flange portion is greater than a diameter of the first opening.

2. The ventilation fan as recited in claim 1, wherein the housing further includes two extension portions which have slots, and the two extension portions are disposed inside the housing.

3. The ventilation fan as recited in claim 2, wherein each of the elastic elements is a metal element with V-shaped structure and a bending portion thereof is connected to the lamp cover.

4. The ventilation fan as recited in claim 3, wherein each of the elastic elements is disposed to pass through a corresponding one of the slots.

5. The ventilation fan as recited in claim 3, wherein each of two ends of each of the plurality of elastic elements has a hook structure which is fixed to one of the two extension portions.

6. The ventilation fan as recited in claim 1, wherein ends of the plurality of contact portions connected to the ceiling are connected by a connection element.

7. The ventilation fan as recited in claim 1, wherein the fan module includes:

a fan casing including an inlet opening and an outlet opening which communicates with the second opening;

an impeller disposed in the fan casing; and a motor connected to and driving the impeller to rotate.

8. The ventilation fan as recited in claim 7, wherein outer diameters of the motor and the impeller are less than an inner diameter of the first opening, respectively.

9. The ventilation fan as recited in claim 7, wherein at least half of the volume of the fan module is on a projection plane of the first opening.

10. The ventilation fan as recited in claim 1, wherein the height of the gap is between 5 mm and 15 mm.

11. A ventilation fan with a lamp, comprising:

a housing including a first opening, a second opening and at least one extension portion which has slots, wherein the extension portion is disposed in the housing;

a fan module disposed in the housing; and a lamp module disposed through the first opening and including:

a lamp cover including a flange portion and a plurality of contact portions connected to the flange portion, wherein both the flange portion and the plurality of contact portions are disposed outside the housing, the contact portions have at least one sidewall which is not also the outer edge of the flange portion, the plurality of contact portions form a plurality of gaps therebetween, and the gaps serve as a height of each of the plurality of contact portions, and the height is equal to a vertical width of an air inlet of the ventilation fan;

a base disposed on the lamp cover, wherein the base does not directly contact with the housing; and a lens disposed opposite to the base and connected to the lamp cover;

wherein the lamp module is fixed to the first opening by a plurality of elastic elements passing through the slots;

wherein an annular wall portion of the housing is at the first opening, the base of the lamp module is surrounded by the annular wall portion of the housing at the first opening, and a diameter of the flange portion is greater than a diameter of the first opening.

12. The ventilation fan as recited in claim 11, wherein ends of the plurality of contact portions away from the flange portion are connected by a connection element.

13. The ventilation fan as recited in claim 11, wherein the fan module includes:

a fan casing including an inlet opening and an outlet opening which communicates with the second opening;

an impeller disposed in the fan casing; and a motor connected to and driving the impeller to rotate.

14. The ventilation fan as recited in claim 13, wherein outer diameters of the motor and the impeller are less than an inner diameter of the first opening, respectively.

15. The ventilation fan as recited in claim 11, wherein at least half of the volume of the fan module is on a projection plane of the first opening.

16. The ventilation fan as recited in claim 11, wherein the height of each of the plurality of the contact portions is between 5 mm and 15 mm.

17. A ventilation fan with a lamp, comprising:

a housing including a first opening, a second opening and at least one extension portion which has slots, wherein the extension portion is disposed in the housing;

a fan module disposed in the housing; and a lamp module disposed through the first opening and including:

a lamp cover including a flange portion and a plurality of contact portions connected to the flange portion, wherein both the flange portion and the plurality of contact portions are disposed outside the housing, the contact portions have at least one sidewall which is not also the outer edge of the flange portion, the plurality of contact portions form a plurality of gaps therebetween, and the gaps serve as a height of each of the plurality of contact portions, and the height is equal to a vertical width of an air inlet of the ventilation fan;

a base disposed on the lamp cover, wherein the base does not directly contact with the housing; and a lens disposed opposite to the base and connected to the lamp cover;

wherein the lamp module is fixed to the first opening by a plurality of elastic elements passing through the slots; and each of the elastic elements is a metal element with V-shaped structure and a bending portion thereof is connected to the lamp cover;

wherein an annular wall portion of the housing is at the first opening, the base of the lamp module is surrounded by the annular wall portion of the housing at the first opening, and a diameter of the flange portion is greater than a diameter of the first opening.

* * * * *